US005570162A

United States Patent [19]

Sohmiya

[11] Patent Number: 5,570,162

[45] Date of Patent: Oct. 29, 1996

[54] CHARGE DEPOSITING MEMBER AND IMAGE FORMING APPARATUS USING THE SAME

[75] Inventor: Norimasa Sohmiya, Soka, Japan

[73] Assignee: Ricoh Company, Ltd., Tokyo, Japan

[21] Appl. No.: 377,048

[22] Filed: Jan. 23, 1995

[30] Foreign Application Priority Data

Jan. 23, 1994 [JP] Japan ..... 6-23390
Dec. 29, 1994 [JP] Japan ..... 6-338420

[51] Int. Cl.[6] ..... G03G 15/02; G03G 15/14

[52] U.S. Cl. ..... 355/219; 355/271; 361/225

[58] Field of Search ..... 355/219, 271–274; 361/225

[56] References Cited

U.S. PATENT DOCUMENTS 4,379,630 12/1983 Suzuki .
5,177,549 1/1993 Ohtsuka et al. ..... 355/274 X
5,253,022 10/1993 Takeuchi et al. ..... 355/274
5,438,399 8/1995 Asai ..... 355/273
5,450,180 9/1995 Ohzeki et al. ..... 355/274

FOREIGN PATENT DOCUMENTS 64-6988 1/1989 Japan .
2-239272 9/1990 Japan .
2-285377 11/1990 Japan .
5-241458 9/1993 Japan .

*Primary Examiner*—R. L. Moses
*Attorney, Agent, or Firm*—Oblon, Spivak, McClelland, Maier & Neustadt, P.C.

[57] ABSTRACT

A charge roller, transfer roller or similar charge depositing member, and an image forming apparatus using such a member. The charge depositing member has a surface portion made of a material whose electric resistance decreases with an increase in voltage applied to the member. A constant current power source applies the current to a core on which the surface portion is formed. The electric resistance of the material changes in an amount greater than 1 order and smaller than 3 order. The volume resistivity of the material is variable within a range of from $10^6$ Ωcm to $10^{11}$ Ωcm.

7 Claims, 3 Drawing Sheets

CHARGE DEPOSITING MEMBER AND IMAGE FORMING APPARATUS USING THE SAME

BACKGROUND OF THE INVENTION

The present invention relates to a member for depositing a charge on a desired object in contact therewith, and a copier, facsimile apparatus, printer or similar image forming apparatus using it.

In the imaging art, there has been proposed a system wherein a charge depositing member applied with a voltage is held in contact with an image carrier or an image transfer member in order to charge the image carrier or to transfer a toner image from the image carrier to a transfer medium. This kind of system is desirable from the environment and energy saving standpoint and taught in, for example, "Fundamentals and Applications of Electrophotographic Technologies", the Institute of Electrophotographic Engineers of Japan, pp. 217–218 and pp. 318–302 (published by Corona), and Japanese Patent Laid-Open Publication Nos. 3-100579 and 3-202885. Japanese Patent Laid-Open Publication No. 2-311868, for example, discloses a charge depositing member implemented as a charge roller. The charge roller has a conductive core or shaft, an intermediate surface layer formed on the shaft and made of EPDM whose volume resistivity is $10^4$ Ωcm to $10^5$ Ωcm, a hydrin rubber layer formed on the intermediate surface layer, and a layer coating the hydrin rubber layer and made of nylon whose volume resistivity is $10^8$ Ωcm to $10^{11}$ Ωcm. The charging or image forming system using such a charge depositing member is advantageous over a system relying on discharge in that it produces a minimum of ozone and saves power.

The charge depositing member, or donor, of the kind described is usable not only to effect charging and image transfer in an image forming apparatus but also to deposit a charge on a desired object, or acceptor, in other various fields. The advantages over the system using a discharge are also available in respect of environment and energy saving.

The material forming the surface portion of the donor is required to have particular conductivity satisfying a required charge deposition characteristic. Such conductivity of the material may be provided by polar groups originally contained in the material or ions added to the material. This type of material will be referred to as a material of type A hereinafter, as distinguished from a material of type B, which will be described. Examples of the material of type A are hydrin rubber, nitril rubber, urethane rubber or similar polar rubber, and EPDM and silicone rubber to which is added various kinds of metal ion salts, surface active agents or similar ion agents.

The material of type A, containing polar groups and ions, exhibits a current-to-voltage characteristic conforming to the Ohm's rule. However, the problem is that the material of type A is susceptible to the environment, particularly humidity, since the polar groups and ions adsorb water. As a result, the electric resistance of this material noticeably changes depending on the environment. For example, the electric resistance increases by about 2 order on the transition from normal humidity (about 60%RH) to low humidity (about 15%RH) or decreases by about 1 order to 2 order on the transition from normal humidity to high humidity (about 90%RH). Assume that the surface of the donor is made of such a material. Then, when the resistance changes due to a change in environment, a voltage or current noticeably changes based on the Ohms' rule with the result that the charge deposition characteristic of the donor changes. Consequently, in the case of charging or image transfer, the charge characteristic or the image transfer characteristic changes.

To deal with the material of type A stated above, the environment (temperature and humidity) may be sensed so as to control the voltage to the donor on the basis of the varying environment. Alternatively, the current may be sensed before each operation so as to change the voltage in matching relation to the current. However, the environment sensing scheme is not satisfactory since a sensor responsive to the environment is problematic in accuracy and feedback delay. Particularly, when the donor is applied to an image forming apparatus, attractive images are not achievable unless the voltage is fully corrected against the environment.

Further, the change in voltage or current attributable to the environment causes the load acting on a power source, assigned to the donor, to change over a broad range. The power source, therefore, must have a great capacity, i.e., a high allowable upper limit of output voltage or output current. This increases not only the cost but also the size of the power source and obstructs the miniaturization of the entire apparatus.

While materials sufficiently small in the change of electric resistance and exhibiting a current-to-voltage characteristic matching the Ohm's rule are in development, an ideal material has not been reported yet.

SUMMARY OF THE INVENTION

It is, therefore, an object of the present invention to provide a charge depositing member having a stable charge deposition characteristic immune to the environment, and operable with a miniature and inexpensive power source.

It is another object of the present invention to provide a charge depositing member for charging or image transfer and having a stable charge characteristic or image transfer characteristic immune to the environment, and operable with a miniature and inexpensive power source.

It is a further object of the present invention to provide an image forming apparatus capable of forming desirable images with charge depositing members for charging and image transfer each having a stable charge characteristic or image transfer characteristic immune to the environment, and operable with a miniature and inexpensive power source.

A member for depositing a charge on a preselected object in contact therewith of the present invention has a core and a surface portion formed on the core and contacting the object. The surface portion is made of a material whose electric resistance decreases with an increase in a voltage applied to the member

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
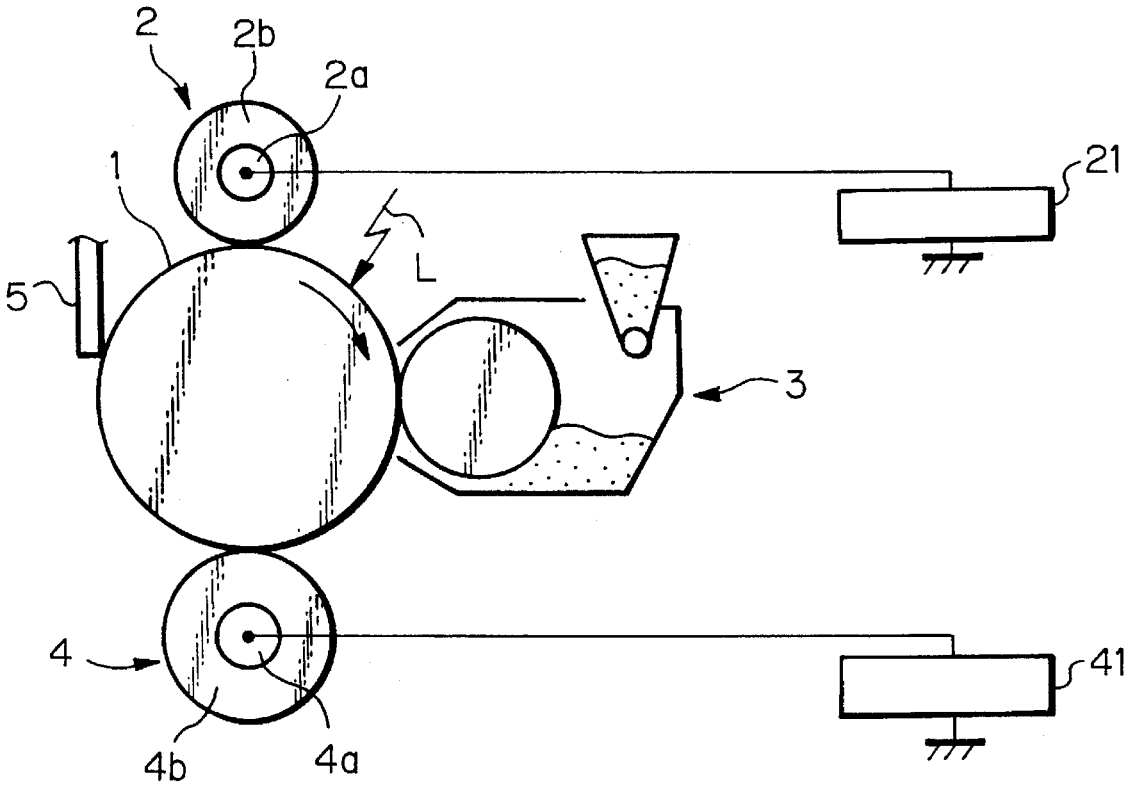
FIG. 1 is a section showing the general construction of an image forming apparatus embodying the present invention.

Referring to FIG. 1 of the drawings, an image forming apparatus embodying the present invention is shown and implemented as a copier by way of example. As shown, the copier has a photoconductive element 1 in the form of a drum. A charge roller, or charge depositing member, 2 uniformly charges the surface of the drum 1 to a predetermined potential. An exposing device, not shown, scans the charged surface of the drum 1 with imagewise light L to electrostatically form a latent image. A developing unit, or developing means, 3 develops the latent image by toner for thereby producing a corresponding toner image. A transfer roller, or another charge depositing means, 4 transfers the toner image from the drum 1 to a transfer medium or paper, not shown. A cleaning blade, or cleaning means, 5 cleans the surface of the drum 1 after image transfer.

The charge roller 2 is implemented as a cylindrical member made up of a conductive core or shaft 2*a* and a rubber layer 2*b* formed on the shaft 2*a*. The rubber layer 2*b*, forming the surface of the charge roller 2 has a medium resistance, i.e., volume resistivity of $10^6$ Ωcm to $10^{11}$ Ωcm, preferably $10^6$ Ω/cm$^2$ to $10^{11}$ Ω/cm$^2$, preferably $10^7$ Ω/cm$^2$ to $10^{11}$ Ω/cm$^2$. The surface of the rubber layer 2*b* contacts the drum 1. A voltage is applied from a power source 21 to the shaft 2*a* of the charge roller 2. Likewise, the transfer roller 4 has a conductive shaft 4*a* and a rubber layer 4*b* formed on the shaft 4*a* and provided with the same volume resistivity and surface resistivity as the rubber layer 2*b*. The surface of the rubber layer 4*b* contacts the drum 1. The rubber layer 4*b* and the drum 1 nip a paper therebetween. A voltage is applied from a power source 41 to the shaft 4*a* of the transfer roller 4.

Figure 2:
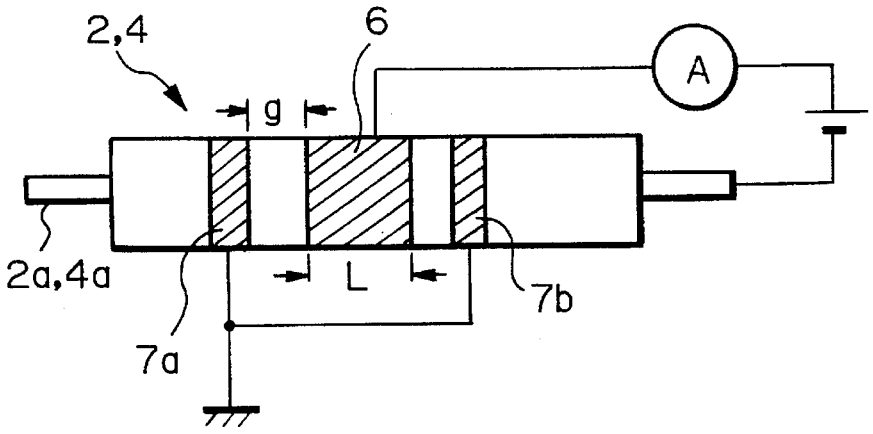
FIG. 2 shows a specific arrangement for measuring the volume resistivity and surface resistivity of a rubber layer provided on each of a charge roller and a transfer roller included in the embodiment.

FIG. 2 shows a specific arrangement for measuring the volume resistivities of the rubber layers 2*b* and 4*b*. As shown, a measuring electrode 6 and guard electrodes 7*a* and 7*b* are formed on each of the rubber layers 2*a* and 2*b*. The guard electrodes 7*a* and 7*b* are connected to ground. A voltage is applied to between the shaft 2*a* or 4*a* and the measuring electrode 6 in order to measure the resulting current. A resistance R is produced from the applied voltage and measured current. A volume resistivity $\rho_B$ is calculated on the basis of the resistance L by use of the following equation:

$$\rho_B = \frac{2\pi L}{\ln(b/a)} R \qquad \text{Eq. (1)}$$

where a and b are respectively the diameter of the shaft 2*a* or 4*a* and the outside diameter of the rubber layer 2*a* or 4*a*, and L is the axial length of the measuring electrode 6.

The surface resistivity of each of the rubber layers 2*b* and 4*b* is measured by the following method. As also shown in FIG. 2, a voltage is applied between the measuring electrode 6 and the guard electrode 7*a* (or 7*b*) in order to measure the resulting current. A resistance R is produced from the applied voltage and measured current. A surface resistivity $\rho_S$ is calculated on the basis of the resistance L by use of the following equation:

$$\rho_S = \frac{2\pi b}{g} R \qquad \text{Eq. (2)}$$

where g is the axial length of a gap between the measuring electrode 6 and the guard electrode 7*a* (or 7*b*).

The rubber layers 2*b* and 4*b* may be made of the previously stated material of type A. Alternatively, to provide the rubber layers 2*a* and 4*b* with conductivity, use may be made of a material in which conductive fine grain, e.g., carbon or metal grain are dispersed in an insulating substance containing substantially no polar groups or ions. This alternative material will be referred to as a material of type B hereinafter.

Figure 3A:
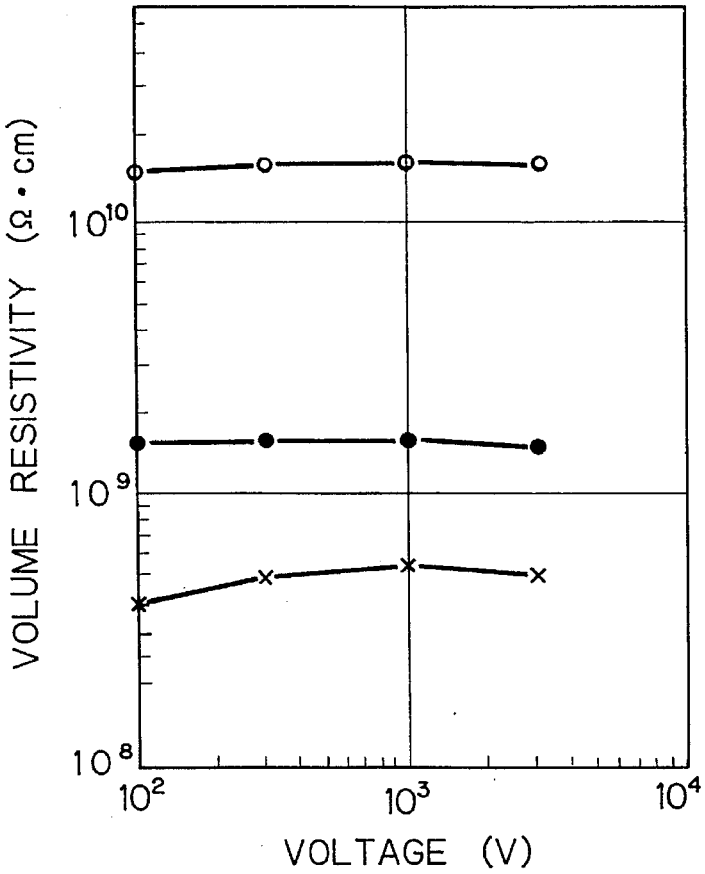
FIGS. 3A and 3B are graphs respectively indicating a relation between the volume resistivity of the material of type A and the applied voltage and a relation between the current and the voltage applied to the same material.
Figure 3B:
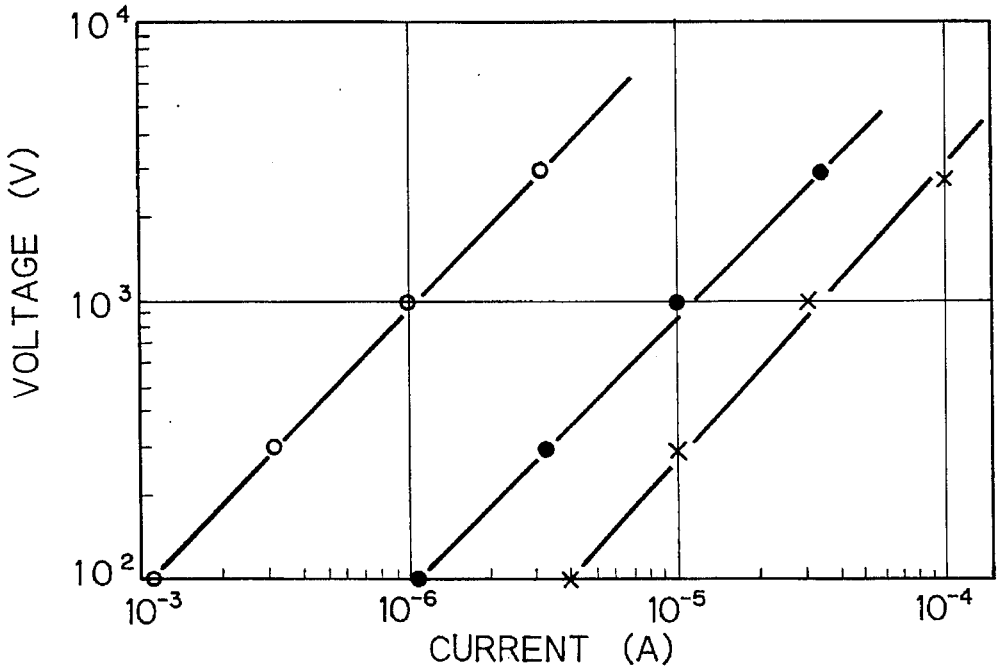

As shown in FIGS. 3A and 3B, the material of type A exhibits a voltage-to-resistance characteristic and a current-to-voltage characteristic conforming to the Ohm's rule. However, this kind of material is susceptible to the environmental conditions (temperature, humidity, etc.), particularly humidity. Specifically, the electric resistance of the material of type A noticeably changes depending on the environment. In FIGS. 3A and 3B, dots, circles and crosses respectively indicate data measured at normal temperature and normal humidity (23° C. and 60% RH), at low temperature and low humidity (10° C. and 15% RH), and at high temperature and high humidity (30° C. and 90% RH). Volume resistivities shown in the figures were measured by the method shown in FIG. 2.

Figure 4A:
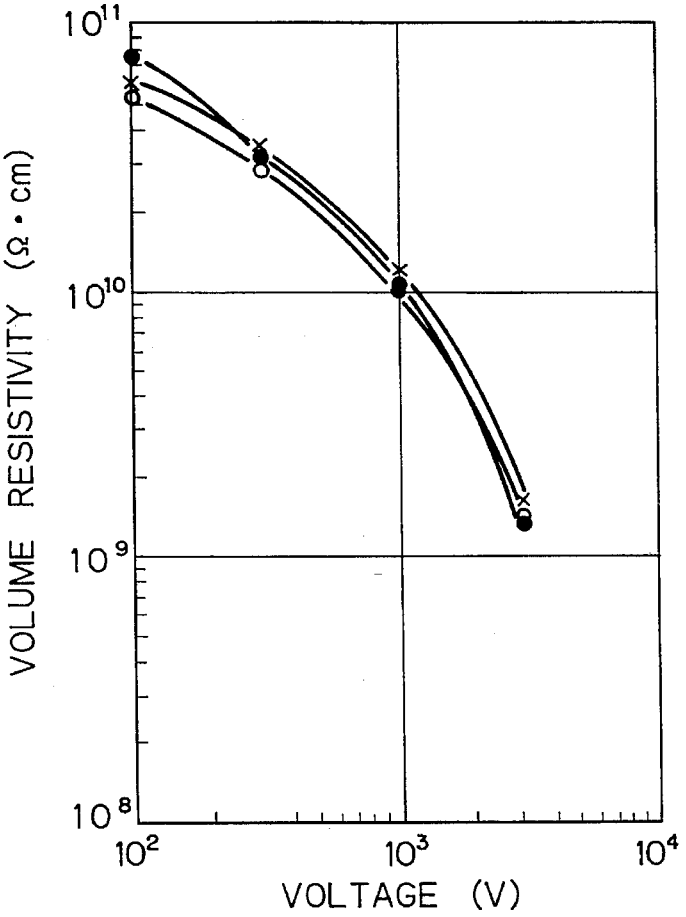
FIG. 4A and 4B are graphs respectively indicating a relation between the volume resistivity of a material of type B particular to the embodiment and the applied voltage and a relation between the current and the voltage applied to the same material.
Figure 4B:
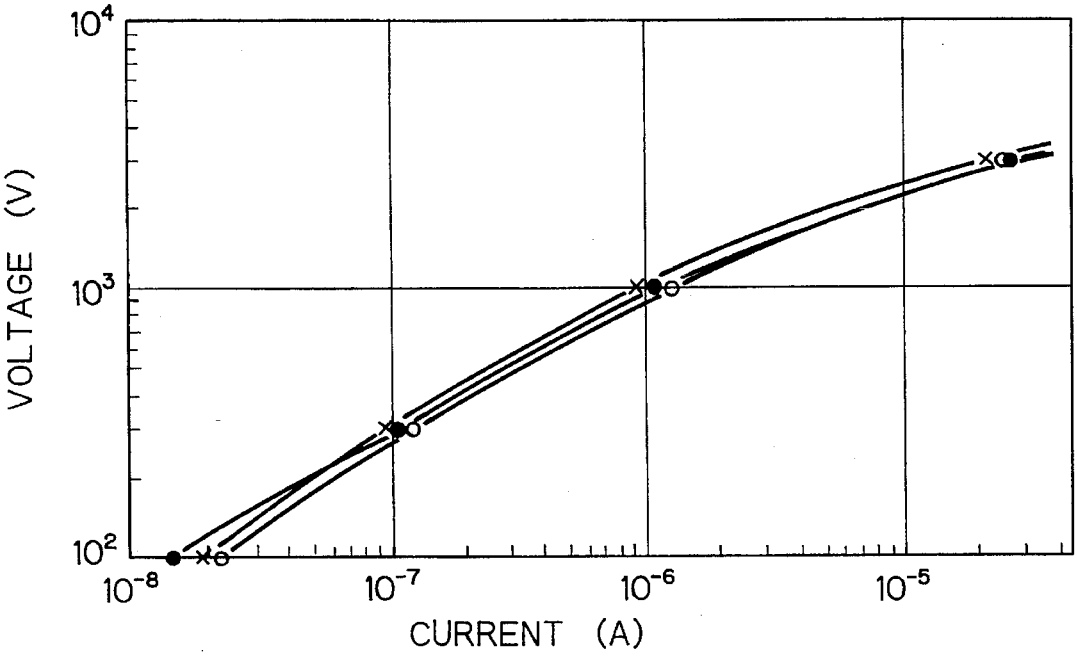

In the illustrative embodiment, the material of type B, whose electric characteristic is little susceptible to the environment (particularly humidity) as shown in FIGS. 4A and 4B, is used to form the rubber layers 2*a* and 2*b*. To prepare the material of type B, carbon, metallic grain or similar conductive fine grain may be dispersed in EPDM, silicone rubber or similar insulating rubber such that the resulting mixture has the predetermined electric resistance stated above. Presumably, why the electric characteristic of the material of type B is little susceptible to environment, particularly humidity, is that it does not contain polar groups or ions which adsorb water easily, and the base material and carbon or similar conductive fine grain contained therein adsorb water little.

As shown in FIGS. 4A and 4B, the material of type B has a voltage-to-resistance characteristic and a current-to-voltage characteristic which do not conform to the Ohm's rule, i.e., the resistance decrease with an increase in voltage. This presumably stems from an occurrence that carbon or similar conductive fine grain forms different chains therein and allows a current to flow through the insulating portions between the chains due to the tunnel effect of electrons; the current flows more easily as the voltage increases.

In addition, paying attention to the electric characteristic of the material of type B not matching the Ohm's rule, the embodiment uses constant current power sources suitable for the application of voltages to the charge roller 2 and transfer roller 4 having the rubber layers 2*b* and 4*b* implemented by the material of type B. This successfully prevents loads on the power sources from increasing.

In operation, when the surface of the drum 1 passes through a position where it contacts the charge roller 2, a constant current flows to such a position from the constant current power source 21. As a result, a predetermined charge is deposited on the drum 1 so as to uniformly charge the surface of the drum 1. While the target value of the current to flow through the contact position depends on the kind and rotation speed of the drum 1, it may be 30 μA to 80 μA by way of example. The potential for uniformly charging the drum 1 may be preselected to range from 700 V to 900 V ±30 V. The exposing device, not shown, scans the charged surface of the drum 1 with imagewise light, thereby electrostatically forming a latent image on the drum 1. The developing unit 3 deposits toner on the latent image so as to produce a corresponding toner image. When the toner image moves through between the drum 1 and the transfer roller 4, a current flows from the constant current power source 41 to a position where the roller 4 contacts a paper. Consequently, a predetermined charge is deposited on the paper. The resulting electric field transfers the toner image from the drum 1 to the paper. The current to flow through the contact position between the transfer roller 4 and the paper has a target value which is usually about ±2 μA, while the output voltage of the power source 41 is about ±1 kV. After the image transfer to the paper, impurities on the drum 1, including remaining toner, are removed by the cleaning blade 5, so that the drum 1 is prepared for the next image forming operation. When the power source 21 for the charge roller 2 is implemented as a constant current power source, any irregular potential distribution left on the drum 1 before charging will prevent the charge roller 2 from uniformly charging the drum 1. In light of this, a discharging device should preferably be used to sufficiently discharge the surface of the drum 1 before uniform charging.

As stated above, in the illustrative embodiment, the rubber layers **2*b* and 4*b* of the charge roller 2 and transfer roller 4, respectively, can be made of a material of type B whose electric resistance decreases with an increase in applied voltage. Therefore, the electric resistance on the surface of each roller 2 or 4 is little susceptible to the environment, particularly humidity. This insures stable charge deposition without resorting to, for example, voltage control otherwise executed on the basis of sensed environment. Further, desirable charge and image transfer characteristics immune to the environment, particularly humidity, are achievable only if the rubber layers 2*b* and 4*b* are formed on the cores 2*a* and 4*a***, respectively. As a result, the embodiment is capable of producing attractive images.

The resistance of the material consisting the rubber layers **2*b* and 4*b* and, therefore, the voltage or current to be applied to the rollers 2 and 4 does not noticeably change. Hence, loads on the power sources 21 and 41 are prevented from increasing due to the varying environment. This successfully lowers the upper limit of voltage or current required of the power sources 21 and 41** and thereby reduces the cost and size of such power sources.

The material of type B implementing the rubber layers **2*b* and 4*b*** can be produced and controlled to the predetermined resistance more easily than the material of type A.

In the embodiment, the rollers 2 and 4 whose rubber layers **2*b* and 4*b* are made of the material of type B and the constant current power sources 21 and 41 are combined. Assume that the current increases due to a change in the output the power source 21 or 41 during the course of operation or due to a change in the setting for control. Then, as shown in FIGS. 4A and 4B, the combination of roller 2 or 4 and power source 21 or 41 allows the changed current to flow to the roller 2 or 4 with a voltage undergone a minimum of increase acting on the material, compared to the configuration using the material of type A. In this manner, since the voltages applied to the rubber layers 2*b* and 4*b* do not noticeably increase despite the increase in current, the output voltages of the power sources 21 and 41 are prevented from sharply increasing. The power sources 21 and 41 are, therefore, free from excessive loads and have an enhanced margin as to the upper voltage limit. It follows that the upper voltage limit of the power sources 21 and 41** can be further lowered in order to reduce cost and size.

In the embodiment, the change to occur in the output voltages of the power sources 21 and 41 when the current changes in smaller than when use is made of the material of type A which conforms to the Ohm's rule, as stated above. Therefore, the embodiment obviates a leak as surely as when the power sources 21 and 41 are implemented as constant voltage power sources.

In the invent of image transfer from the drum 1 to a paper, the paper intervenes between the drum 1 and the transfer roller 4. In this condition, the electric resistance of the paper is added to that of the surface of the roller 4. However, the tendency that the margin of the power source 41 as to the upper voltage limit increases, as well as the other tendency, is also achievable without regard to the size and kind of the paper. This is presumably because the resistance of the paper is substantially constant without regard to the applied voltage, so that the dependency of the entire resistance between the drum 1 and the shaft **4*a* of the roller 4** on the applied voltage does not noticeably change without regard to the presence/absence of a paper.

When the electric resistance of the material constituting the rubber layers **2*b* and 4*b* changes in an amount smaller than 1 order, it is difficult to produce the material and, moreover, the change in voltage increases relative to the change in current. On the other hand, when the amount of change in the resistance of the material is greater than 3 order, the resistance of the charge roller 2 and transfer roller 4 decreases to an excessive degree; a leak is apt to occur due to, for example, pin holes in the drum 1**. It is, therefore, preferable that the amount of change in the resistance of the material matching the voltage range during use, i.e., the practical voltage range (e.g. 0.5 kV to 5 kV) be greater than 1 order and smaller than 3 order. More specifically, the amount of change in such a voltage range is by about 2 order.

When the material constituting the rubber layers **2*b* and 4*b* has a volume resistivity lower than $10^6$ Ωcm, it is almost conductive. In this condition, a leak is apt to occur due to, for example, pin holes in the drum 1** and obstructs the expected charge or image transfer. On the other hand, when the volume resistivity is higher than $10^{11}$ Ωcm, the flow of a current is obstructed with the result that a high voltage is necessary for the predetermined charge to deposit. In addition, such a volume resistivity lowers the time response. For these reasons, the electric resistance of the material matching the previously mentioned practical voltage range (e.g. 0.5 kV to 5 kV) should preferably change within the range of from $10^6$ Ωcm to $10^{11}$ Ωcm, more preferably from $10^7$ Ωcm to $10^{11}$ Ωcm.

While the two different charge depositing means described above are respectively implemented as the rollers 21 and 41, they may be implemented as belts, brushes or blades, if desired.

The charge depositing means have been shown and described as being comprised of the roller 2 for uniforming charging the drum 1 and the roller 4 for transferring a toner image from the drum 1 to a paper. However, the embodiment is similarly applicable to any other kind of charge depositing members. For example, in an image forming apparatus of the type having an intermediate image transfer element between a photoconductive element and a paper, the embodiment is applicable to a device for transferring a toner image from the photoconductive element to the intermediate image transfer element and a device for transferring the toner image from the intermediate element to a paper. Moreover, the embodiment is not limited to an image forming apparatus, but it is practicable with various kinds of apparatuses which need stable charge deposition without regard to the varying environment (temperature and humidity) and need small size and low cost power sources.

In summary, it will be seen that the present invention has various unprecedented advantages as enumerated below.

(1) A charge depositing member, or donor, has a surface portion contacting a desired object, or acceptor, and made of a material whose electric resistance decreases with an increase in an applied voltage. Such a material can be produced with hardly any polar group or ion existing therein and with the electric resistance thereof controlled to predetermined one. Therefore, the electric resistance of the surface portion of the donor is little susceptible to the environment, particularly humidity. When this kind of donor deposits a charge on the acceptor, a voltage or current applied to the donor is prevented from noticeably changing despite a change in environment. This insures stable charge deposition on the acceptor.

(2) When the donor is a body to be charged or a transfer material to which toner should be transferred from an image carrier, a stable charge characteristic or a stable image transfer characteristic is achievable without regard to the varying environment.

(3) Since the voltage or current in the donor does not noticeably change despite a change in environment, the upper voltage or current limit of the output of a power source can be lowered. As a result, a miniature and inexpensive power source is usable.

(4) The electric resistance of the material is controlled to predetermined one due to carbon, metallic grain or similar conductive fine grain dispersed therein. Hence, this kind of material is easier to produce than a material of the type whose major component is polar groups and ions which are difficult to control in respect of electric resistance.

(5) When the power source for the donor is implemented as a constant current power source, the output voltage of the power source is prevented from changing despite the varying environment. In addition, even when the output current changes or when the current changes due to a change in the setting of the output current, the voltage applied to the donor does not greatly change. This eliminates an occurrence that the output voltage of the power source sharply increases and imposes an excessive load on the power source. As a result, the upper limit of the output voltage can be lowered, and the cost and size of the power source can be reduced.

(6) Particularly, when the material constituting the surface portion of the donor is variable in resistance by more than 1 order, it can be produced with ease. Further, since a change in voltage does not excessively increase relative to a change in current, there can be obviated leaks due to pin holes and other defects existing in the acceptor and leaks at the ends of the acceptor. Hence, the charge deposition characteristic and charging and image transfer characteristics are maintained stable. In addition, the margin of the power source with respect to the upper voltage limit is enhanced.

(7) When the resistance of the material changes in an amount smaller than 3 order, the resistance is prevented from lowering to an excessive degree. This also obviates leaks due to pin holes and other defects existing in the acceptor and leaks at the ends of the acceptor, thereby further stabilizing the characteristics mentioned above.

(8) When the volume resistivity of the material changes in a range above $10^6$ Ωcm, leaks due to pin holes and other defects existing in the acceptor and leaks at the ends of the acceptor are further reduced. This also stabilizes the characteristics mentioned above.

(9) When the volume resistivity of the material changes in a range below $10^{11}$ Ωcm, a high voltage is not necessary for a predetermined charge to deposit on the acceptor. This, coupled with the fact that leaks are reduced, further stabilizes the characteristics mentioned above and prevents the time response for charge deposition, charge or image transfer from being lowered.

(10) When the donor is applied to an image forming apparatus, an attractive image is attainable due to the stable charge and image transfer characteristics little susceptible to the environment.

(11) When the power source for the donor is implemented as a constant current power source, the upper limit of the output thereof can be lowered. This further reduces the cost and size of the image forming apparatus.

Various modifications will become possible for those skilled in the art after receiving the teachings of the present disclosure without departing from the scope thereof.

What is claimed is:

1. A member for depositing a charge on a preselected object in contact with said object, comprising:

a core; and a surface portion formed on said core and contacting the object, said surface portion being made of a material whose electric resistance decreases with an increase in a voltage applied to said member.

2. A member as claimed in claim 1, wherein the object comprises a transfer medium to which a substance electrostatically deposited on a substance carrier is to be transferred.

3. A member as claimed in claim 1, wherein the object comprises an element to be charged.

4. A member as claimed in claim 1, wherein said material has an electric resistance variable in an amount greater than 1 order and smaller than 3 order in association with a range of the voltage to be applied.

5. A member as claimed in claim 1, wherein said material has an electric resistance variable in a range of from $10^6$ Ωcm to $10^{11}$ Ωcm in terms of volume resistivity in association with a range of the voltage to be applied.

6. A member as claimed in claim 1, further comprising a power source for applying the voltage to said member.

7. A member as claimed in claim 6, wherein said power source comprises a constant current power source.

* * * * *